US006596449B2

(12) United States Patent
Shimada et al.

(10) Patent No.: US 6,596,449 B2
(45) Date of Patent: Jul. 22, 2003

(54) ELECTROPHOTOGRAPHIC PHOTORECEPTOR, AND PROCESS CARTRIDGE AND ELECTROPHOTOGRAPHIC IMAGE FORMING APPARATUS USING THE ELECTROPHOTOGRAPHIC PHOTORECEPTOR

(75) Inventors: Tomoyuki Shimada, Shizuoka-ken (JP); Kazukiyo Nagai, Shizuoka-ken (JP); Chiaki Tanaka, Shizuoka-ken (JP); Michihiko Namba, Kanagawa-ken (JP); Shinichi Kawamura, Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/897,924

(22) Filed: Jul. 5, 2001

(65) Prior Publication Data

US 2002/0045117 A1 Apr. 18, 2002

(30) Foreign Application Priority Data

Jul. 4, 2000 (JP) ..... 2000-202091
Jul. 2, 2001 (JP) ..... 2001-201201

(51) Int. Cl.[7] ..... G03G 5/047
(52) U.S. Cl. ..... 430/58.05; 430/58.7; 399/159
(58) Field of Search ..... 430/66, 58.05, 430/58.7; 399/159

(56) References Cited

U.S. PATENT DOCUMENTS

| | | | | |
|---|---|---|---|---|
| 3,180,730 A | | 4/1965 | Klupfel et al. | 96/1 |
| 3,265,496 A | | 8/1966 | Fox | 96/1 |
| 5,457,232 A | | 10/1995 | Tanaka et al. | 564/426 |
| 5,459,275 A | | 10/1995 | Tanaka et al. | 548/145 |
| 5,576,132 A | | 11/1996 | Tanaka et al. | 430/59 |
| 5,587,516 A | | 12/1996 | Tanaka et al. | 564/405 |
| 5,599,995 A | | 2/1997 | Tanaka et al. | 564/426 |
| 5,604,065 A | | 2/1997 | Shimada et al. | 430/83 |
| 5,616,805 A | | 4/1997 | Tanaka et al. | 564/405 |
| 5,672,728 A | | 9/1997 | Tanaka et al. | 558/376 |
| 5,672,756 A | | 9/1997 | Shimada et al. | 564/426 |
| 5,817,739 A | * | 10/1998 | Nukada et al. | 528/292 |
| 5,853,935 A | | 12/1998 | Suzuki et al. | 430/859 |
| 5,871,876 A | * | 2/1999 | Ikuno et al. | 430/59 |
| 5,932,384 A | * | 8/1999 | Mitsumori et al. | 430/59 |
| 5,942,362 A | | 8/1999 | Tadokoro et al. | 430/59 |
| 5,942,363 A | | 8/1999 | Tanaka et al. | 430/75 |
| 5,981,124 A | | 11/1999 | Shimada et al. | 430/73 |
| 6,030,733 A | | 2/2000 | Kami et al. | |
| 6,068,956 A | | 5/2000 | Namba et al. | 430/58.3 |
| 6,074,792 A | | 6/2000 | Namba et al. | 430/59.1 |
| 6,093,784 A | | 7/2000 | Tamura et al. | 528/196 |
| 6,103,435 A | | 8/2000 | Shimada et al. | 430/56 |
| 6,139,999 A | * | 10/2000 | Fuller et al. | 30/58.65 |
| 6,184,362 B1 | | 2/2001 | Shimada et al. | 534/658 |
| 6,191,249 B1 | | 2/2001 | Tanaka et al. | 528/196 |
| 6,210,848 B1 | | 4/2001 | Nagai et al. | 430/58.7 |

OTHER PUBLICATIONS

Patent Abstracts of Japan, Publication No. 02–230255, Sep. 12, 1990.
Patent Abstracts of Japan, Publication No. 62–030255, Feb. 9, 1997.
Patent Abstracts of Japan, Publication No. 63–225660, Sep. 20, 1998.
Patent Abstracts of Japan, Publication No. 58–159536, Sep. 21, 1983.
Patent Abstracts of Japan, Publication No. 59–015251, Jan. 26, 1984.
Patent Abstracts of Japan, Publication No. 55–067778, May 22, 1980.
Patent Abstracts of Japan, Publication No. 58–065440, Apr. 19, 1983.
Patent Abstracts of Japan, Publication No. 59–216853.
Patent Abstracts of Japan, Publication No. 01–280763, Nov. 11, 1989.

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoreceptor for an electrophotographic image forming apparatus which has a laser diode or a light emitting diode emitting a light having a wavelength of 350 to 500 nm as an image writing light source, wherein the photoreceptor includes a photosensitive layer including a deactivating agent.

63 Claims, 5 Drawing Sheets

ELECTROPHOTOGRAPHIC PHOTORECEPTOR, AND PROCESS CARTRIDGE AND ELECTROPHOTOGRAPHIC IMAGE FORMING APPARATUS USING THE ELECTROPHOTOGRAPHIC PHOTORECEPTOR

BACKGROUND OF THE INVENTION

1. Field of the Invention

The present invention relates to an electrophotographic photoreceptor, and to a process cartridge and an electrophotographic image forming apparatus using the eletrophotographic photoreceptor. More particularly the present invention relates to an electrophotographic photoreceptor suitable for image writing light having a wavelength of 350 to 400 nm emitted by a light source (hereinafter referred to as a "writing light source") such as laser diodes or light emitting diodes.

2. Discussion of the Background

So far, as photosensitive materials for photoreceptors used for electrophotographic image forming methods, various inorganic and organic photosensitive materials have been used. At this point, the "electrophotographic image forming method" mentioned herein means an image forming process of the so-called Carlson process. The electrophotographic image forming method typically includes the following processes:

(1) a photosensitive photoreceptor is charged, for instance, using corona discharging in a dark place;
(2) the photoreceptor is exposed to imagewise light to selectively decay the charge on the lighted parts of the photoreceptor, resulting in formation of an electrostatic latent image; and
(3) the electrostatic latent image is developed with a toner including a colorant (e.g. dyestuffs and pigments), a polymer, etc. to form a visual image on the photoreceptor.

Photoreceptors using an organic photosensitive material have advantages of having good flexibility in designing a photoreceptor having good photosensitivity to image writing light used, good film formability, good flexibility, high film transparency, good mass productivity, less toxicity, low cost, etc. against photoreceptors including an inorganic photosensitive material. Therefore, organic photosensitive materials are used for almost all the photoreceptors now. In electrophotographic methods and similar processes, photoreceptors are required to have good electrostatic characteristics such as high photosensitivity, appropriate electric potential, high potential retainability, high potential stability, low residual potential and high photosensitivity over a broad wavelength range.

Recent progress of information processing systems using this electrophotographic image forming method is remarkable. Especially, progress of printers using a digital recording method in which information having been converted into digital signals is reproduced using light is remarkable in printing qualities and reliabilities. Such digital recording methods are applied not only to printers but also to ordinary copiers. Thus, digital copiers have been developed. Since various information processing functions can be added to digital copiers, it is considered that the demand for these digital copiers increases more and more.

As writing light sources applicable to the digital recording methods, small, inexpensive and reliable laser diodes (hereinafter referred to as "LD") and light emitting diodes (hereinafter referred to as "LED") which emit light having a wavelength of from about 600 to 800 nm are typically used. The wavelength of light emitted by LDs typically used at present is 780 to 800 nm (i.e. a near infrared region).

At present, as the electrophotographic photoreceptor used for the electrophotographic image forming methods, functionally-separated multi-layer photoreceptors having a charge generation layer on a conductive support and a charge transport layer on the charge generation layer are typically used. In addition, for improving mechanical or chemical durability of the photoreceptors, a protection layer is sometimes formed on the surface of the photoreceptors. As for these functionally-separated multi-layer photoreceptors, when a photoreceptor with a charged surface is exposed to light, the light passes through the charge transport layer and is then absorbed in the charge generation material in the charge generation layer. The charge generation material generates charge carriers by absorbing light. The thus generated charge carriers are injected into the charge transport layer. The charge carriers are transported along an electric field formed by charges on the charge transport layer, resulting in neutralization of the charges of the photoreceptor. Thus, an electrostatic latent image is formed on the surface of the photoreceptor.

In order to impart high sensitivity to such a functionally-separated multi-layer photoreceptor, a combination of a charge generation material mainly having absorption in near infrared to visible regions and a charge transport material having absorption in yellow to ultraviolet regions, which does not prevent transmission of absorbed light toward the charge generation material (i.e., hardly causes masking effects (filtering effects) of writing light) is typically used.

In addition, using such a charge transport layer which does not absorb writing light is important to impart not only high sensitivity but also good charge stability and high image resolution to the photoreceptor. When a charge transport material absorbs writing light, it is known that various photochemical reactions are caused in the photoreceptor.

It is reported by J. Pacansky, et al., in Chem. Mater., 3,912(1991) that when a 4-diethylaminobenzaldehydediphenylhydrazone in a photosensitive layer serving as a charge transport material absorbs light, this compound is changed into an indazole derivative by a ring forming reaction, resulting in an increase of residual potential of the photoreceptor. In addition, it is reported in a thesis of T. Nakazawa, Osaka University (1994) that when a carbazolealdehydediphenylhydrazone derivative absorbs light, a geometric isomerism changes from an anti form to a syn form is made. It is also reported therein that the photosensitivity thereof changes and the residual potential increases because the ionizing potentials of the anti form and syn form are different.

Further, it is reported at page 165 in Japan Hardcopy' 91 thesis that when some charge transport materials absorb light, the materials achieve a photo-excited state and are then deactivated, emitting strong fluorescent lights. It is also reported that the fluorescent light emitted by a charge transport material in a photosensitive layer is partly scattered from the surface of the photosensitive layer, but is mostly closed inside of the photosensitive layer and repeats multi-reflections in the photosensitive layer until it is completely absorbed by one or more materials included in the photosensitive layer. Thus, fluorescent light repeats reflections in the photosensitive layer until it is completely absorbed, and therefore a blurred image is produced, resulting in deterioration of image resolution.

In addition, it is disclosed in Japanese Laid-Open Patent Publication No. 55-67778 that using light having a wavelength as image writing light for a photoreceptor, which the charge transport layer of the photoreceptor absorbs, deteriorates the charge properties of the photoreceptor and increases the residual potential thereof when the photoreceptor is repeatedly used.

Thus, it is known that light absorption by a charge transport material adversely affects not only photosensitivity of the photoreceptor but also charge stability thereof and resolution of latent images formed thereon.

As the charge transport materials for use in electrophotographic photoreceptors, the following compounds have been disclosed.

(1) Triphenylamine compounds (U.S. Pat. No. 3,180,730); (2) benzidine compounds (U.S. Pat. No. 3,265,496 and Japanese Patent Publication No.58-32372); (3) stilbene compounds (Japanese Laid-Open Patent Publication No.58-65440); (4) α-phenylstilbene compounds (Japanese Laid-Open Patent Publication No. 59-216853); (5) aminobiphenyl compounds (Japanese Laid-Open Patent Publication No. 1-280763); (6) 1,1 bis(p-diethylaminophenyl)-4,4-diphenyl-1,3-butadiene compounds (Japanese Laid-Open Patent Publication No. 62-30255); (7) 5-benzylidene-5H-dibenzo [a,d] cycloheptene compounds (Japanese Laid-Open Patent Publication No. 63-225660); (8) hydrazone compounds (Japanese Laid-Open Patent Publications Nos. 58-159536 and 59-15251); and (9) fluorene compounds (Japanese Laid-Open Patent Publication No. 2-230255). These compounds have light absorption in a wavelength range of from about 350 to 500 nm. Namely, these compounds hardly absorb light having a longer wavelength than the above-mentioned wavelength. Therefore, in an electrophotographic image forming method using a conventional LD or LED which emits light having a wavelength of from about 600 to 800 nm for writing images, the above-mentioned problems concerning performances of the charge transport compounds do not occur. Thus such charge transport compounds are widely used because of having high photosensitivity and stability.

However, lately, as a light source for digital recording methods, LDs (short wavelength LDs) and LEDs which emit light having a wavelength of from 400 to 450 nm (i.e., violet to blue light) have been developed and marketed.

When such a LD which emits light having about a half wavelength of that of a conventional near infrared LD is used as a writing light source for a laser scanner head, it is theoretically possible to make the spot diameter of the laser beam on a photoreceptor considerably small as can be understood by the following formula:

$$d\ (\pi/4)(\lambda f/D) \qquad (1)$$

wherein d represents the spot diameter of the laser formed on the photoreceptor; λ represents the wavelength of the laser; f represents the focal distance of the fθlens used; and D represents the lens diameter. Therefore, these short wavelength LDs are very useful for improving image recording density (i.e., image resolution).

In addition, when such a short wavelength LD or LED is used for optical systems of image forming apparatus, a compact and high speed image forming apparatus can be provided. Therefore, a need exists for a stable photoreceptor which has a sensitivity to light having a wavelength of from 400 to 450 nm.

However, the above-mentioned charge transport compounds absorb light having a wavelength of from 350 to 500 nm. According to the study of the present inventors, when a LD or a LED emitting light in this wavelength range is used as a light source for writing images on a photoreceptor, big problems occur such that the photosensitivity of the photoreceptor deteriorates, the residual potential increases and image resolution is decreased (i.e., blurred images are produced).

SUMMARY OF THE INVENTION

Accordingly, an object of the present invention is to provide an electrophotographic photoreceptor that can be stably used and produces images having high resolution even when a LD or a LED emitting light having a wavelength of from 350 to 500 nm is used as a light source.

Another object of the present invention is to provide an image forming apparatus and a process cartridge which can stably produce high resolution images using light having a wavelength of from 350 to 500 nm.

Briefly these object and other objects of the present invention as hereinafter will become more readily apparent can be attained by an electrophotographic photoreceptor including a photosensitive layer including a deactivating agent. The deactivating agent preferably has a charge transportability.

In another aspect of the present invention, an electrophotographic image forming apparatus is provided, which includes the above-mentioned electrophotographic photoreceptor, a charger, a light irradiator using a LD or a LED which emits light having a wavelength of from 350 to 500 nm as a light source, an image developer and an image transfer. The wavelength of the light emitted by the LD or the LED is preferably 400 to 450 nm.

In yet another aspect of the present invention, a process cartridge is provided, which includes the above-mentioned electrophotographic photoreceptor and at least one device selected from the group consisting of a charger, an image developer and a cleaner cleaning the photoreceptor and can be detachably set in an electrophotographic image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides an electrophotographic photoreceptor which is useful for an image forming apparatus using a LD or a LED which emits light having a wavelength of from 350 to 500 nm as a light source and comprises a photosensitive layer including a deactivating agent.

Figure 6:
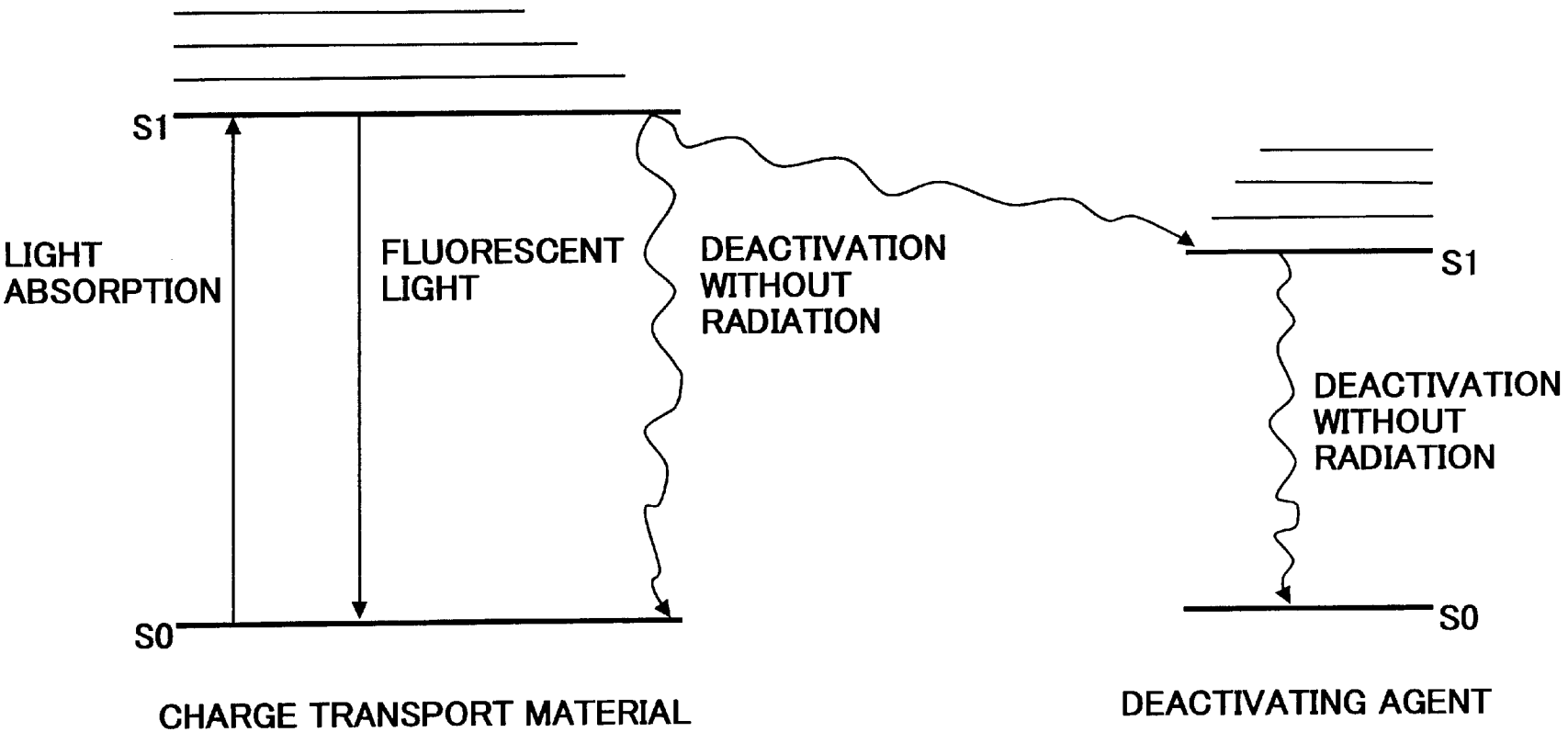
FIG. 6 is an energy diagram for explaining energy transfer between a charge transport material and a deactivating agent.

According to the present invention, by including a deactivating agent in the photosensitive layer of the photoreceptor of the present invention, the above-mentioned problems can be solved. At present, the reaction mechanism of a deactivating agent in the photosensitive layer (i.e., an influence on the photosensitive material therein) is not clarified. However, as shown in FIG. 6, a reaction mechanism is considered such that an energy transfer is made from a charge transport material excited by absorbing light toward the deactivating agent, resulting in deactivation of the deactivating agent without radiation, and thereby immediately returning to a normal state. Thus, the above-mentioned photochemical reactions of the charge transport material are prevented.

Any deactivating agent is available for the photoreceptor of the present invention if the deactivating agent allows a charge transport material to transfer from an excited state to a normal state while deactivating without radiation. However, it is preferable to use a deactivating agent having a charge transportabilitiy to prepare a photoreceptor having good photosensitivity. In addition, it is not preferable to use a deactivating agent having an ionizing potential much less than the transport material included in the photosensitive layer because the deactivating agent often becomes a trap, resulting in a decrease of the charge transportability. However, when the difference in ionizing potential between the deactivating agent and the charge transport material is 0.4 eV or less, it does not cause a serious problem. It is preferable to use a deactivating agent which is not a fluorescent substance.

As such deactivating agents, aromatic hydrocarbon compounds having at least any one substitutuent selected from a nitro group, a carbonyl group, a hydrazone group, and an azo group are preferably used.

In addition, high molecular weight compounds in which the above-mentioned aromatic hydrocarbon compounds are combined with each other through a group such as an ethylene group, a vinylene, group, an ester group, a carbonyloxy group, a phenylene group, etc. can also be used as the deactivating agents. The polystyrene-conversion number average molecular weight of the high molecular weight compounds is preferably from 1000 to 1,000,000, and more preferably from 2000 to 500,000.

It is probable that adding a deactivating agent too much deteriorates the charge generating ability and hole transportability of the photoreceptor. Therefore, it is preferable to add a deactivating agent in the charge transport layer in an amount of from 0.005 to 5% by weight. When a deactivating agent is added in the photosensitive layer, the content is preferably from 1 to 50% by weight.

Next, the photoreceptor of the present invention will be explained in detail, referring to drawings.

Figure 1:
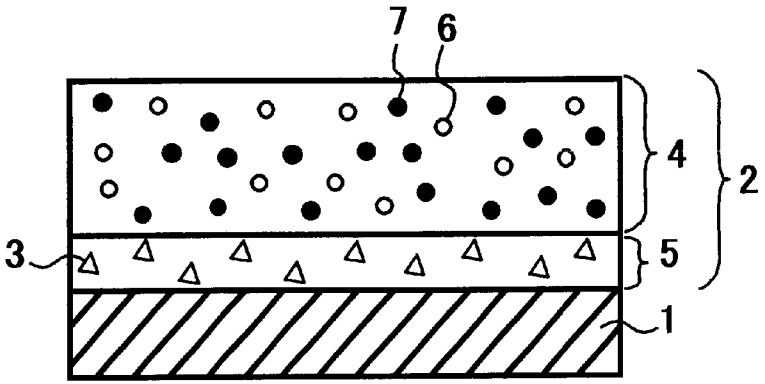
FIG. 1 is a schematic cross-sectional view of an embodiment of the electrophotographic photoreceptor of the present invention.

FIG. 1 is a schematic cross-sectional view of an embodiment of the electrophotographic photoreceptor of the present invention. Numerals 1,2,3,4,5,6 and 7 represent a conductive support, a photosensitive layer, a charge generation material, a charge transport layer, a charge generation layer, a charge transport material and a deactivating agent, respectively. In FIG. 1, the deactivating agent 7 is added in the charge transport layer 4.

The position of the charge transport layer 4 and the charge generation layer 5 may be reversed.

Figure 2:
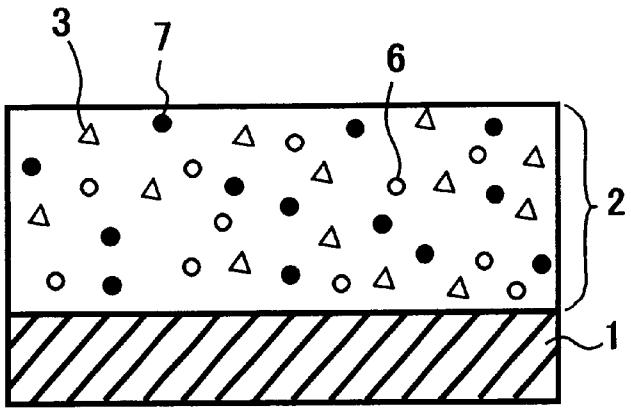
FIG. 2 is a schematic cross-sectional view of another embodiment of the electrophotographic photoreceptor of the present invention.

FIG. 2 shows a photoreceptor having a photosensitive layer 2 on a conductive support 1, in which a charge generation material 3 and a charge transport material 6 are dispersed. This photosensitive layer 2 contains a deactivating agent 7.

In the photoreceptors as shown in FIGS. 1 and 2, an intermediate layer may be formed between the conductive support 1 and the photosensitive layer 2 to improve charge properties of the photoreceptors, and adhesion of the photosensitive layer 2 to the support 1 and to prevent moire images due to interference of the laser light used for writing images. In addition, a protective layer may be formed on the photosensitive layer 2 to improve abrasion resistance and stability to withstand environmental conditions.

Hereinbefore a case in which a photochemical reaction of a charge transport material is prevented by using a deactivating agent is explained. Needless to say, the effect of the deactivating agent can also be exerted even when an additional material is included in the photoreceptor.

Figure 4:
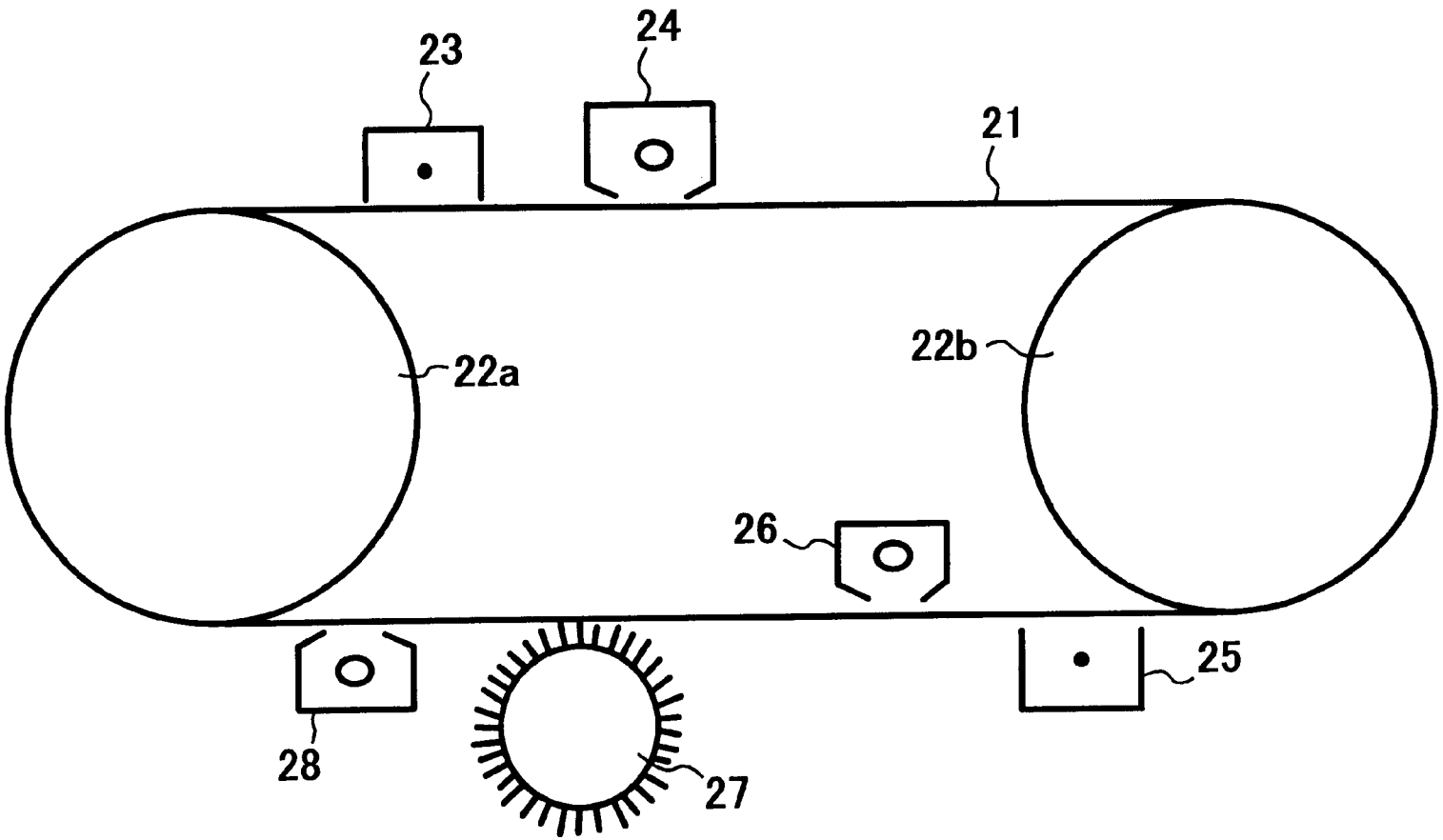
FIG. 4 is a schematic view of another embodiment of the electrophotographic image forming apparatus of the present invention.

The charge transport layer 4 as shown is FIG. 4 and the photosensitive layer as shown in FIG. 2 preferably include a binder resin.

Specific examples of such a binder resin include thermoplastic or thermoset resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinylidene chloride, polyarylate, phenoxy resins, polycarbonate, acetylcellulose resins, ethylcellulose resins, polyvinyl butyral, polyvinyl formal, polyvinyl toluene, poly-N-vinylcarbazole, acrylic resins, silicon resins, epoxy resins, melamine resins, polyurethane resins, phenolic resins and alkyd resins.

As the charge transport material 6 in the charge transport layer 4 in FIG. 1 or the photosensitive layer 2 in FIG. 2, hole transport materials and electron transport materials can be used.

Specific examples of the hole transport materials include poly-N-carbazole and its derivatives, poly-γ-carbazolylethylgultamate and its derivatives, pyrene-formaldehyde condensates and their derivatives, polyvinylpyrene, polyvinylphenanthrene, oxazole derivatives, imidazole derivatives, triphenylamine derivatives and the compounds having one of the following formulae (1) to (23):

(1)

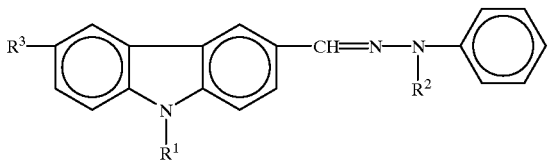

wherein $R^1$ represents a methyl group, an ethyl group, a 2-hydroxyethyl group or 2-chlorethyl group; $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group.

(2)

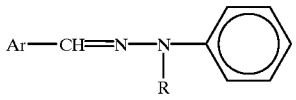

wherein Ar represents a naphthalene ring, an anthracene ring, a pyrene ring, one of their substitution groups, a pyridine ring, a furan ring or a thiophene ring; and R represents an alkyl group, a phenyl group or a benzyl group.

(3)

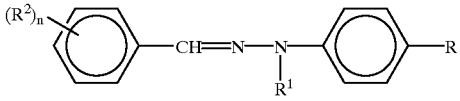

wherein $R^1$ represents an alkyl group, a benzyl group, a phenyl group or a naphthyl group; $R^2$ represents a hydrogen atom, an alkyl group having 1 to 3 carbon atoms, an alkoxy group having 1 to 3 carbon atoms, a dialkylamino group and a diaralkylamino group or a diarylamino group; n represents an integer of from 1 to 4, and each $R^2$ can be the same or different from the others when n is 2 or more; and $R^3$ represents a hydrogen atom or a methoxy group.

(4)

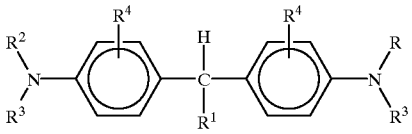

wherein $R^1$ represents an alkyl group having 1 to 11 carbon atoms, a substituted or unsubstituted phenyl group or a heterocyclic ring group; $R^2$ and $R^3$ independently represent a hydrogen atom, an alkyl group having 1 to 4 carbon atoms, a hydroxyalkyl group, a chloralkyl group or a substituted or unsubstituted aralkyl group, and R2 and R3 can be combined to form a heterocyclic ring including a nitrogen atom; and each R4 represents a hydrogen atom, an alkyl group having 1 to 4 carbon atoms, an alkoxy group or a halogen atom.

(5)

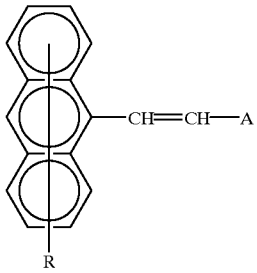

wherein R represents a hydrogen or a halogen atom; and Ar represents a substituted or unsubstituted phenyl group, a naphthyl group and an anthryl group or a carbazolyl group.

(6)

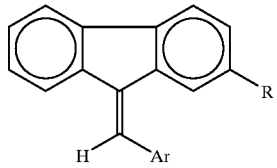

wherein $R^1$ represents a hydrogen atom, a halogen atom, a cyano group, and an alkoxy group having 1 to 4 carbon atoms or an alkyl group having 1 to 4 carbon atoms; and Ar represents one of the following formulae (7) and (8):

(7)

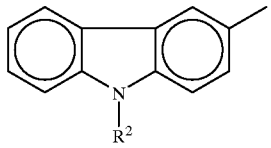

(8)

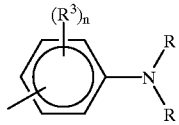

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group; n represents 1 or 2 and each $R^3$ can be the same or different from the other when n is 2; and $R^4$ and $R^5$ independently represent a hydrogen atom, a substituted or unsubstituted alkyl group having 1 to 4 carbon atoms or a substituted or unsubstituted benzyl group.

(9)

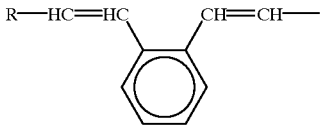

wherein R represents a carbazolyl group, a pyridyl group, a thienyl group, an indolyl group, a furyl group or a substituted or unsubstituted phenyl group, a or a substituted or unsubstituted styryl group, a or a substituted or unsubstituted naphtyl group respectively or a substituted or unsubstituted anthryl group, wherein these substituents are selected from a dialkyl amino group, an alkyl group, an alkoxy group, a carboxyl group or its ester, a halogen atom, a cyano group, an aralkylamino group, an N-alkyl-N-aralkylamino group, an amino group, a nitro group and an acethylamino group.

(10)

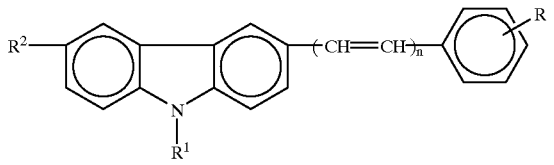

wherein $R^1$ represents an alkyl group having 1 to 4 carbon atoms, a substituted or unsubstituted phenyl group or benzyl group; $R^2$ represents a hydrogen atom, an alkyl group having 1 to 4 carbon atoms, an alkoxy group having 1 to 4 carbon atoms, a halogen atom, a nitro group, an amino group or an amino group substituted by an alkyl group having 1 to 4 carbon atoms or benzyl group; and n is an integer of 1 or 2.

(11)

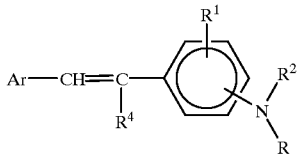

wherein $R^1$ represents a hydrogen atom, an alkyl group, an alkoxy group or a halogen atom; $R^2$ and $R^3$ independently represent an alkyl group, a substituted or unsubstituted aralkyl group or a substituted or unsubstituted aryl group; $R^4$ represents a hydrogen atom, an alkyl group having 1 to 4 carbon atoms or a substituted or unsubstituted phenyl group; and Ar represents a substituted or unsubstituted phenyl group or naphthyl group.

(12)

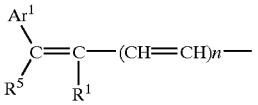

wherein n is 0 or 1; $R^1$ represents a hydrogen atom, an alkyl group or a substituted or unsubstituted phenyl group; Ar1 represents a substituted or unsubstituted aryl group; $R^5$ represents a substituted or unsubstituted alkyl group including a substituted alkyl group or a substituted or unsubstituted aryl group; A represents (13)

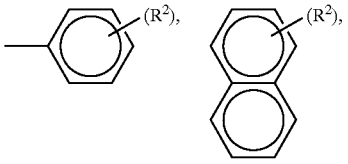

9-anthryl group or a substituted or unsubstituted carbazolyl group; and R2 represents a hydrogen atom, an alkyl group, an alkoxy group, a halogen atom or (14)

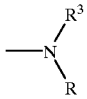

wherein, $R^3$ and $R^4$ independently represent an alkyl group, a substituted or unsubstituted aralkyl group or a substituted or unsubstituted aryl group and $R^4$ can form a ring; m is an integer of from 1 too 5; and $R^2$ can be the same or different from each other when m is 2 or more; and A and $R^1$ may form a ring when n is 0.

(15)

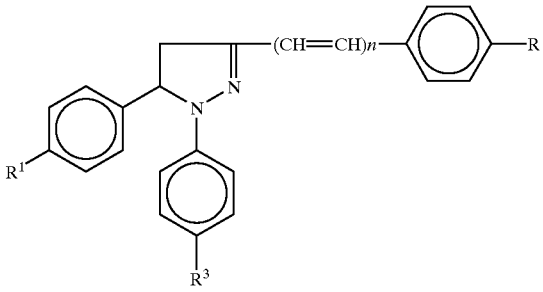

wherein $R^1$, $R^2$ and $R^3$ independently represent a hydrogen atom, an alkyl group having 1 to 4 carbon atoms, an alkoxy group having 1 to 4 carbon atoms, a halogen atom or a dialkylamino group; and n is 0 or 1.

(16)

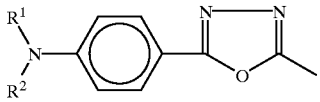

wherein $R^1$ and $R^2$ represent a substituted or unsubstituted alkyl group or a substituted or unsubstituted aryl group; and A represents a substituted amino group, a substituted or unsubstituted aryl group or an allyl group.

(17)

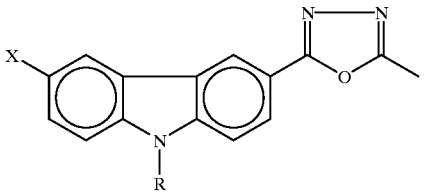

wherein X represents a hydrogen atom, an alkyl group having 1 to 4 carbon atoms or a halogen atom; R represents a substituted or unsubstituted alkyl group or a substituted or unsubstituted aryl group; and A represents a substituted amino group or a substituted or unsubstituted aryl group.

(18)

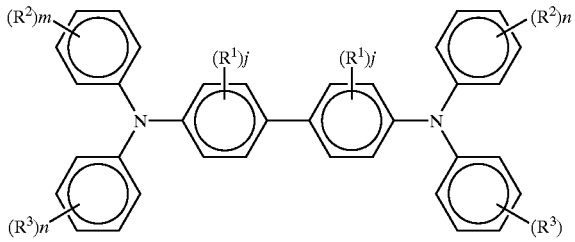

wherein $R^1$ represents an alkyl group having 1 to 4 carbon atoms, an alkoxy group having 1 to 4 carbon atoms or a halogen atom; $R^2$ and $R^3$ independently represent a hydrogen atom, an alkyl group having 1 to 4 carbon atoms, an alkoxy group having 1 to 4 carbon atoms or a halogen atom; and j, m, and n are independently 0 or an integer of from 1 to 4.

(19)

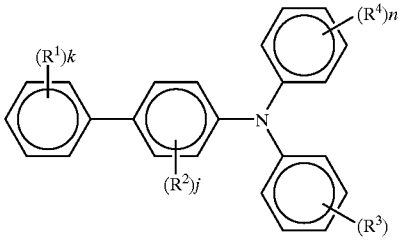

wherein $R^1$, $R^3$ and $R^4$ independently represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group, and $R^2$ represents a hydrogen atom, an alkoxy group, a substituted or unsubstituted alkyl group or a halogen atom, but a case in which $R^1$, $R^2$, $R^3$ and $R^4$ are all hydrogen atoms is excluded. k, j, m, and n are independently an integer of from 1 to 4; and $R^1$, $R^2$, $R^3$ and $R^4$ can be the same or different from the others when k, j, m, and n are an integer of from 2 to 4.

(20)

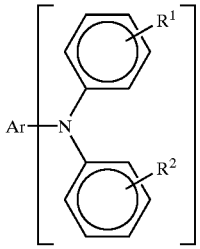

wherein Ar represents a condensation polycyclic hydrocarbon group having 18 or less carbon atoms which can have a substituent; and $R^1$ and $R^2$ independently represent a hydrogen atom, a halogen atom, a substituted or unsubstituted alkyl group, an alkoxy group, or a substituted or unsubstituted phenyl group and n is 1 or 2.

A—CH═CH—Ar—CH═CH— (21)

wherein Ar represents a substituted or unsubstituted aromatic hydrocarbon group; and A represents (22)

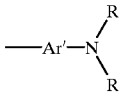

wherein Ar' represents a substituted or unsubstituted aromatic hydrocarbon group; and $R^2$ and $R^2$ independently represent substituted or unsubstituted alkyl group or a substituted or unsubstituted aryl group.

(23)

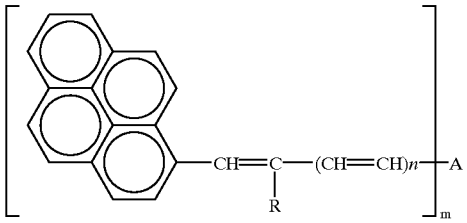

wherein Ar represents a substituted or unsubstituted aromatic hydrocarbon group; R represents a hydrogen atom, a substituted or unsubstituted alkyl group or a substituted or unsubstituted aryl group; n is 0 or 1; m is 1 or 2; and Ar and R may form a ring when n is 0 and m is 1.

Specific examples of the compounds represented by formula 1 include 9-ethylcalbazole-3-aldehyde-1-methyl-1-phenylhydrazone, 9-ethylcalbazole-3-aldehyde-1-benzyl-1-phenylhydrazone, 9-ethylcalbazole-3-aldehyde-1,1-diphenylhydrazone, etc.

Specific examples of the compounds represented by formula 2 include 4-diethylaminostyryl-β-aldehhyde-1-methyl-1-phenylhydrazone, 4-methoxynaphthalene-1-aldehyde-1-benzyl-1-phenylhydrazone, etc.

Specific examples of the compounds represented by formula 3 include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, 4-dibenzylaminobenzaldehyde-1,1-diphenylhydrazone, etc.

Specific examples of the compounds represented by formula 4 include 1,1-bis(4-dibenzylaminophenyl)propane, tris(4-diethylaminophenyl)methane, 1,1-bis(4-dibenzylaminophenyl)propane, 2,2'-dimethyl-4,4'-bis(diethylamino)-triphenylmethane, etc.

Specific examples of the compounds represented by formula 5 include 9-(4-diethylaminostyryl)anthracene, 9-bromo-10-(4-diethylaminostyryl)anthracene, etc.

Specific examples of the compounds represented by formula 6 include 9-(4-dimethylaminobenzylidene)fluorene, 3-(9-fluorenylidene)-9-ethylcarbazole, etc.

Specific examples of the compounds represented by formula 9 include 1,2-bis-(4-diethylaminostyryl)benzene, 1,2-bis(2-,4-dimethoxystyryl)benzene, etc.

Specific examples of the compounds represented by formula 10 include 3-styryl-9-ethylcarbazole, 3-(4-methoxystyryl)-9-ethylcarbazole, etc.

Specific examples of the compounds represented by formula 11 include 4-diphenylaminostilbene, 4-dibenzylaminostilbene, 4-ditolylaminostilbene, 1-(4-iphenylaminostyryl)naphthalene, 1-(4-diethylaminostyryl)naphthalene, etc.

Specific examples of the compounds represented by formula 12 include 4'-diphenylamino-α-phenylstilbene, 4'-bis(4-methylphenyl)amino-α-phenylstilbene, etc.

Specific examples of the compounds represented by formula 15 include 1-phenyl-3-(4-diethylaminostyryl)-5-(4-diethylaminophenyl)pyrazoline, etc.

Specific examples of the compounds represented by formula 16 include 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole, etc.

Specific examples of the compounds represented by formula 17 include 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole, etc.

Specific examples of the benzidine compounds represented by formula 18 include N,N'-diphenyl-N,N'-bis(3-methylphenyl)-[1,1'-biphenyl]-4,4'-diamine, 3,3'-dimethyl-N,N,N',N'-tetrakis(4-methylphenyl)-[1,1'-biphenyl]-4,4'-diamine, etc.

Specific examples of the biphenylamine compounds represented by formula 19 include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine, etc.

Specific examples of the triarylamine compounds represented by formula 20 include 1-diphenylaminopyrene, 1-di(p-tolylamino)pyrene, N,N-di(p-tolyl)-1-naphthylamine, N,N-di(p-tolyl)-1-phenanthorylamine, 9,9-dimethyl-2-(di-p-tolylamino)fluorene, N,N,N',N'-tetrakis(4-methylphenyl)-phenanthrene-9,10-diamine, N,N,N',N'-tetrakis(3-methylphenyl)-m-phenylenediamine, etc.

Specific examples of the diolefin aromatic compounds represented by formula 21 include 1,4-bis(4-diphenylaminostyryl)benzene, 1,4-bis[4-di(p-tolyl)aminostyryl]benzene, etc.

Specific examples of the styrylpyrene compounds represented by formula 23 include 1-(4-diphenylaminostyryl)pyrene, 1-[4-di(p-tolyl)aminostyryl]pyrene, etc.

Specific examples of the electron transport materials include chloranil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno[1,2-b]thiophene-4-one, and 1,3,7-trinitrodibenzothiophene-5,5-dioxide, etc. In addition, electron transport materials represented by one of the following formulae 24, 25 and 26 are preferably used.

(24)

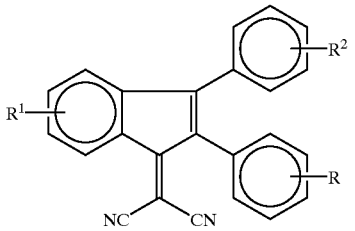

wherein $R^1$, $R^2$ and $R^3$ independently represent a hydrogen atom, a halogen atom, a substituted or unsubstituted alkyl group, an alkoxy group or a substituted or unsubstituted phenyl group.

(25)

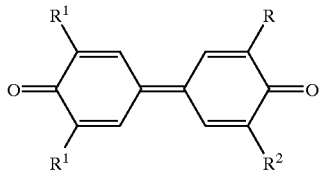

wherein $R^1$ and $R^2$ independently represent a hydrogen atom, a substituted or unsubstituted alkyl group, or a substituted or unsubstituted phenyl group.

(26)

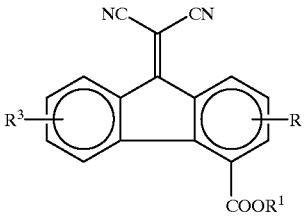

wherein $R^1$, $R^2$ and $R^3$ independently represent a hydrogen atom, a halogen atom, a substituted or unsubstituted alkyl group, an alkoxy group or a substituted or unsubstituted phenyl group.

These charge transport materials can be used alone or in combination.

The content of the charge transport material in the charge transport layer is from 20 to 300 parts by weight, and preferably from 40 to 150 parts by weight, per 100 parts by weight of the binder resin included in the charge transport layer. The charge transport layer preferably has a thickness of from about 5 to 30 $\mu$m. Specific examples of the solvents used for forming a charge transport layer include tetrahydrofuran, dioxane, toluene, dichloromethane, monochlorobenzene, dichloroethane, cyclohexanone, methyl ethyl ketone, acetone, etc.

In the present invention, plasticizers and leveling agents can be added into the charge transport layer 4. Specific examples of the plasticizers include general resin plasticizers such as dibutylphthalate and dioctylphthalate. The content of the plasticizer in the charge transport layer is about 0 to 30% by weight against the binder resin therein. Specific examples of the leveling agents include silicone oils such as dimethylsilicone oil, methylphenylsilicone oil and polymers or oligomers having a perfluoroalkyl group. The content of the leveling agent in the charge transport layer is 0 to 1% by weight against the binder resin therein.

In the present invention, suitable materials for use as the conductive support 1 include plates, drums, or foils of a metal such as aluminium, nickel, copper, titanium, gold and stainless steel; plastic films evaporated with a material such as aluminium, nickel, copper, titanium, gold, tin oxide, and indium oxide; and films or drums of a material such as papers and plastics which are coated with a conductive material.

The main component of the intermediate layer formed on the conductive support is a resin. When considering that the photosensitive layer is formed on the intermediate layer by coating a coating liquid including a solvent, the resin in the intermediate layer preferably has good resistance to general organic solvents.

Specific examples of such resins include water soluble resins such as polyvinylalcohol, casein and sodium polyacrylate; alcohol soluble resins such as nylon copolymers and methoxymethylated nylon, and heat or photo-curing resins forming a 3-dimensional network structure, such as polyurethane resins, melamine resins, phenolic resins, alkyd-melamine resins and epoxy resins.

In order to prevent moire and optimize the resistance of the intermediate layer, powders of a metal oxide such as titanium oxide, silica, alumina, zirconium oxide, tin oxide and indium oxide can be added. The intermediate layer can be formed by using an appropriate solvent and a coating method. In addition, silane coupling agents, titanium coupling agents, chrome coupling agents, etc. can be used in the intermediate layer. In addition, an $Al_2O_3$ layer formed by an anodic oxidation method, a layer of an organic substance such as polyparaxylene (parylene), or a layer of an inorganic substance such as $SiO_2$, $SnO_2$, $TiO_2$, ITO and $CeO_2$, which is formed by a vacuum thin film forming method can also be used as the intermediate layer. Further, known intermediate layers can also be used. The intermediate layer preferably has a thickness of from 0 to 5 $\mu$m.

The charge generation layer 5 can be formed by coating a coating liquid which is preferably dissolving or dispersing a charge generation material in an appropriate solvent together with a binder resin if necessary and then drying the coated liquid.

As the dispersing method for preparing the charge generation layer coating liquid, ball mills, supersonic dispersing machines, homomixers, etc. can be used. Suitable coating methods include a dipping coating method, a blade coating method, a spray coating method, etc.

When dispersing a charge generation material, the charge generation material preferably has a particle diameter not greater than 2 $\mu$m, and more preferably not greater than 1 $\mu$m, in order to improve the dispersibility. However, if the diameter is too small, the charge generation material is likely to aggregate, resulting in an increase of the resistance of the layer and deterioration of the photosensitivity and the repeat usage properties due to increase of crystal defects. In addition, there is a limit in microlizing the charge generation material, and therefore the particle diameter is preferably not less than 0.01 $\mu$m. The thickness of the charge generation layer is from 0.01 to 5 $\mu$m, and preferably from 0.1 to 2 $\mu$m.

Specific examples of the charge generation materials include organic pigments such as azo pigments e.g. CI Pigment Blue 25 (Color Index CI 21180), CI Pigment Red 41 (CI 21200), CI Acid Red 52 (CI 45100), CI Basic Red 3 (CI 45210), azo pigments having a carbazole skeleton (disclosed in Japanese Laid-Open Patent Publication No. 53-95033), azo pigments having a distyrylbenzene skeleton (disclosed in Japanese Laid-Open Patent Publication No. 53-133445), azo pigments having a triphenylamine skeleton (disclosed in Japanese Laid-Open Patent Publication No. 53-132347), azo pigments having a dibenzothiophene skeleton (disclosed in Japanese Laid-Open Patent Publication No. 54-21728), azo pigments having an oxadiazole skeleton (disclosed in Japanese Laid-Open Patent Publication No. 54-12742), azo pigments having a fluorenone skeleton (disclosed in Japanese Laid-Open Patent Publication No. 54-22834), azo pigments having a bisstilbene skeleton (disclosed in Japanese Laid-Open Patent Publication No. 54-17733), azo pigments having a distyrylcarbazole skeleton (disclosed in Japanese Laid-Open Patent Publication No. 54-14967) and azo pigments having a benzanthrone skeleton; phthalocyanine pigments such as CI Pigment Blue 16 (CI 74100), oxotitaniumphthalocyanine, chlorogalliumphthalocyanine and hydroxygalliumphthalocyanine; indigo pigments such as CI Vat Brown 5 (CI 73410) and CI Vat Dye (CI 73030); and perylene pigments such as Algo Scarlet B (Bayer), Indanthrene Scarlet R(Bayer), etc. These charge generation materials can be used alone or in combination.

As the solvents used for preparing a coating dispersion or solution for the charge generation layer, for instance, N,N-dimethylformamide, toluene, xylene, monochlorbenzene, 1,2-dichlorethane, 1,1,1-trichlorethane, dichlormethane, 1,1,2-trichlorethane, trichlorethylene, tetrahydrofuran, methyl ethyl ketone, methyl isobutyl ketone, cyclohexanone, ethyl acetate, butyl acetate, dioxane, etc. can be used.

As the binder resins for use in the charge generation layer, any binder resins can be used if they have good insulation properties. For instance, insulative resins made by addition polymerization methods, polyaddition methods and polycondensation methods, such as polyethylene, polyvinylbutyral, polyvinylformal, polystyrene resins, phenoxy resins, polypropylene, acrylic resins, methacrylic resins, vinyl chloride resins, vinyl acetate resins, epoxy resins, polyurethane resins, phenolic resins, polyester resins, alkyd resins, polycarbonate resins, polyamide resins, silicon resins and melamine resins; and copolymer resins including 2 or more of the repeated units of these resins, such as vinylchloride-vinylacetate copolymers, styrene-acryl copolymers, and vinylchloride-vinylacetate-maleicanhyderide copolymers; and organic polymer semiconductors, such as poly-N-vinylcarbazole can be used. These binder resins can be used alone or in combination. The contents of the binder resin is 0 to 500 parts by weight, and preferably 10 to 300 parts by weight per 100 parts by weight of the charge generation material in the charge generation layer.

In addition, phenol compounds, hydroquinone compounds, hindered phenol compounds, hindered amine compounds and compounds having a hindered amine and a hindered phenol in a molecule, etc. can be added into the above-mentioned photosensitive layer for the purpose of improving an electrostatic property of the photoreceptor.

In addition, a protective layer can be formed on the photosensitive layer of the present invention for the purpose of increasing mechanical and chemical durability of the photoreceptor. The protective layer is formed overlying the photosensitive layer 2.

Specific examples of the materials for use in the protective layer include resins such as ABS resins, ACS resins, olefin-vinyl-monomer-copolymers, chlorinated polyether, allyl resins, phenol resins, polyacetal, polyamide, polyamideimide, polyacrylate, polyallylsulfone, polybutylene, polybutyleneterephthalate, polycarbonate, polyethersulfone, polyethylene, polyethyleneterephthalate, polyimide, acrylic resins, polymethylpentene, polypropylene, polyphenyleneoxido, polysulfone, polystyrene, AS resins, butadiene-styrene copolymers, polyurethane, polyvinylchloride, polyvinylidenechloride and epoxy resins.

For the purpose of improving the abrasion resistance, fillers can be added into the protective layers. Specific examples of such fillers include one or mixtures of titanium oxide, tin oxide, zinc oxide, zirconium oxide, indium oxide, silicon nitride, calcium oxide, barium oxide, ITO(indium tin oxide), silica, colloidal silica, carbon black, particulate fluorocarbon resins, particulate polysiloxane resins and particulate charge transport polymer materials.

These fillers may be subjected to a surface treatment with an inorganic and organic substance to improve dispersibility, surface quality, etc. of the fillers.

The fillers may be subjected to a water-repellent treatment such as treatments using a silane coupling agent, a fluorine-containing silane coupling agent, a higher fatty acid or treatments in which the fillers are copolymerized with a polymer material. In addition, treatments using an inorganic substance such as alumina, zirconia, tin oxide and silica can also be used.

The fillers are mixed with a low molecular weight charge transport material and/or a charge transport polymer material together with a binder resin if necessary in a dispersion solvent by being optionally pulverized. The content of fillers in the charge transport layer is 5 to 50% by weight, and preferably 10 to 40% by weight. When the content is less than 5%, the abrasion resistance is not satisfactory. When the content is greater than 50%, the transparency of the charge transport layer and the sensitivity of the photoreceptor deteriorate. The average particle diameter of the filler is from 0.05 to 1.0 μm, and preferably from 0.05 to 0.8 μm. A particle with a big diameter of the filler causes a damage to a cleaning blade because the filler projects from the surface of the photoreceptor, resulting in a cleaning defect and an image deterioration of image qualities.

Specific examples of the dispersion solvent include ketones such as methyl ethyl ketone, acetone, methyl isobutyl ketone and cyclohexanone; ethers such as dioxane, tetrahydrofuran and ethylcellosolve; aromatic series such as toluene and xylene; halogen-containing solvents such as chlorobenzene and dichlormethane; and esters such as ethyl acetate and butyl acetate. When a pulverizing process is performed, ball mills, sand mills, vibrating mills, etc. can be used. As the methods of forming the protective layer, known coating methods can be used. The thickness of the protective layer is preferably 0.1 to 10 μm. Any known materials such as amorphous-carbon and amorphous-silicon carbide formed by a vacuum thin film forming method can also be used as the protective layer.

Next, the electrophotographic image forming method and apparatus of the present invention will be explained in detail, referring to drawings.

Figure 3:
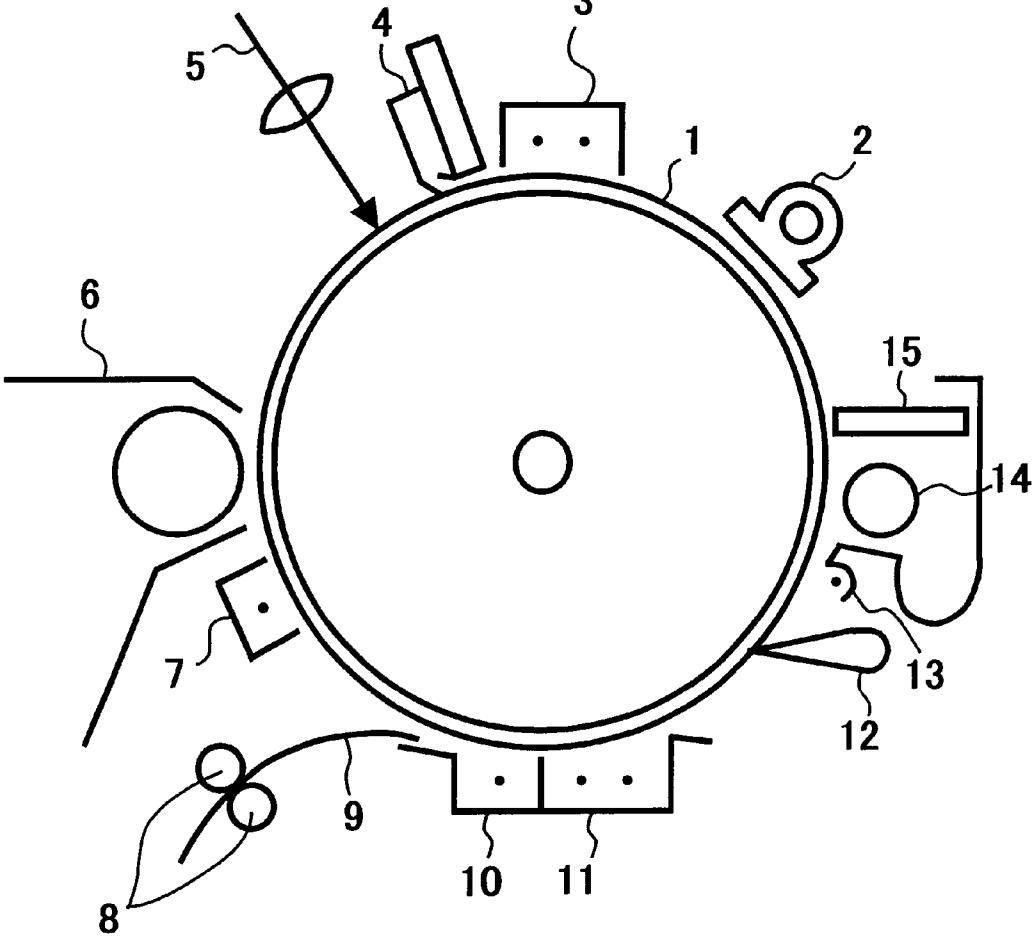
FIG. 3 is a schematic view of an embodiment of the electrophotographic image forming apparatus of the present invention.

FIG. 3 is a schematic view of an embodiment of the electrophotographic image forming apparatus of the present invention. The image forming apparatus of the present invention is not limited thereto and the following modified examples may be included in the present invention.

In FIG. 3, electrophotographic photoreceptor 1 has a drum-shape, however, sheet and endless belt photoreceptors can also be used. For a charger 3, a pre-transfer charger 7, a transfer charger 10, a separation charger 11 and a pre-cleaning charger 13, known chargers such as corotrons, scorotrons, solid state chargers and charging rollers can be used.

For the transfer means, the above-mentioned chargers can be used, however, a combination of a transfer charger 10 and a separation charger 11 as shown in FIG. 3 is preferable.

For an image irradiator 5, a LD or a LED emitting light having a wavelength of 350 to 500 nm is used. As a light source for a discharging lamp 2, etc., any known illuminators such as fluorescent lamps, tungsten lamps, halogen lamps, mercury lamps, sodium lamps, light emitting diodes (LEDs), laser diodes (LDs) and electro luminescense(EL) lamps can be used. In order to irradiate only the light having a desired wavelength, various filters such as sharp cut filter, band pass filter, near infrared cutting filter, dichroic filter, interference filter and conversion filters can also be used. Such light sources can also be used for irradiating the photoreceptor in processes such as a transfer process combined with light irradiation, a charge eliminating process, a cleaning process, a pre-exposure process, etc. as well as the processes mentioned above.

Toner images formed on the photoreceptor 1 by developing unit 6 are transferred on a transfer paper 9 which is fed by a pair of registration rollers 8 at the transfer position using the transfer charger 10 and separation charger 11. The transfer paper 9 having the toner images thereof is then separated from the photoreceptor 1 by a separation pick 12. However, all of the toner particles of the toner images are not transferred on the transfer paper 9 and there also remain toner particles on the photoreceptor 1. Such toner particles are removed from photoreceptors by a fur brush 14 and a blade 15. Cleaning may be made only by a cleaning brush such as fur brushes and mag-fur brushes. A numeral 4 denotes an eraser which erases (i.e. discharges) a part of charged areas of the photoreceptor 1.

When positively or negatively charging an photoreceptor and performing image exposure, positive (negative) electrostatic latent images are formed on the surface of the photoreceptor. Positive images are obtained when the latent images are developed with negatively-charged (positively-charged) toners and negative images are obtained when the latent images are developed with positively-charged (negatively-charged) toners.

As the developing method, known developing methods can be applied. In addition, known discharging methods can be used for discharging the charges remaining on the photoreceptor.

FIG. 4 shows another embodiment of the electrophotographic image forming apparatus of the present invention. A photoreceptor 21 has the photosensitive layer of the present invention, and is driven by driving rollers 22*a* and 22*b*. The photoreceptor 21 is charged by a charger 23, and exposed to light emitted by a light source 24 to form a latent image thereon. Then the latent image is developed by an image developer (not illustrated) to form a toner image thereon. The toner image is transferred on a transfer paper (not shown) using a charger 25. The photoreceptor 21 is then subjected to a cleaning pre-exposure treatment using a light source 26, a cleaning treatment using a brush 27 and a discharging treatment using a light source 28. These processes are repeatedly performed to produce images. In FIG. 4, pre-cleaning light irradiates the photoreceptor 21 from the support side. (In this case, the support is transparent.)

For instance, in FIG. 4, although the cleaning pre-exposure is made from the support side, the cleaning pre-exposure may be made from the photosensitive layer side. In addition, irradiation of image exposure and discharging can be made from the support side.

With respect to the light irradiation processes, the image exposure, cleaning pre-exposure and discharging exposure are illustrated. However, light irradiation such as pre-transfer exposure, pre-exposure of image exposure and other known light irradiation processes can be made to the photoreceptors.

The electrophotographic image forming devices as mentioned above can be fixedly installed into copiers, facsimiles and printers. In addition, they can be installed into these devices in the form of a process cartridge as well. The process cartridge is a device (part) containing at least a photoreceptor, and at least one of a charger, an image irradiator, an image developer, an image transfer, a cleaner and a discharger.

Figure 5:
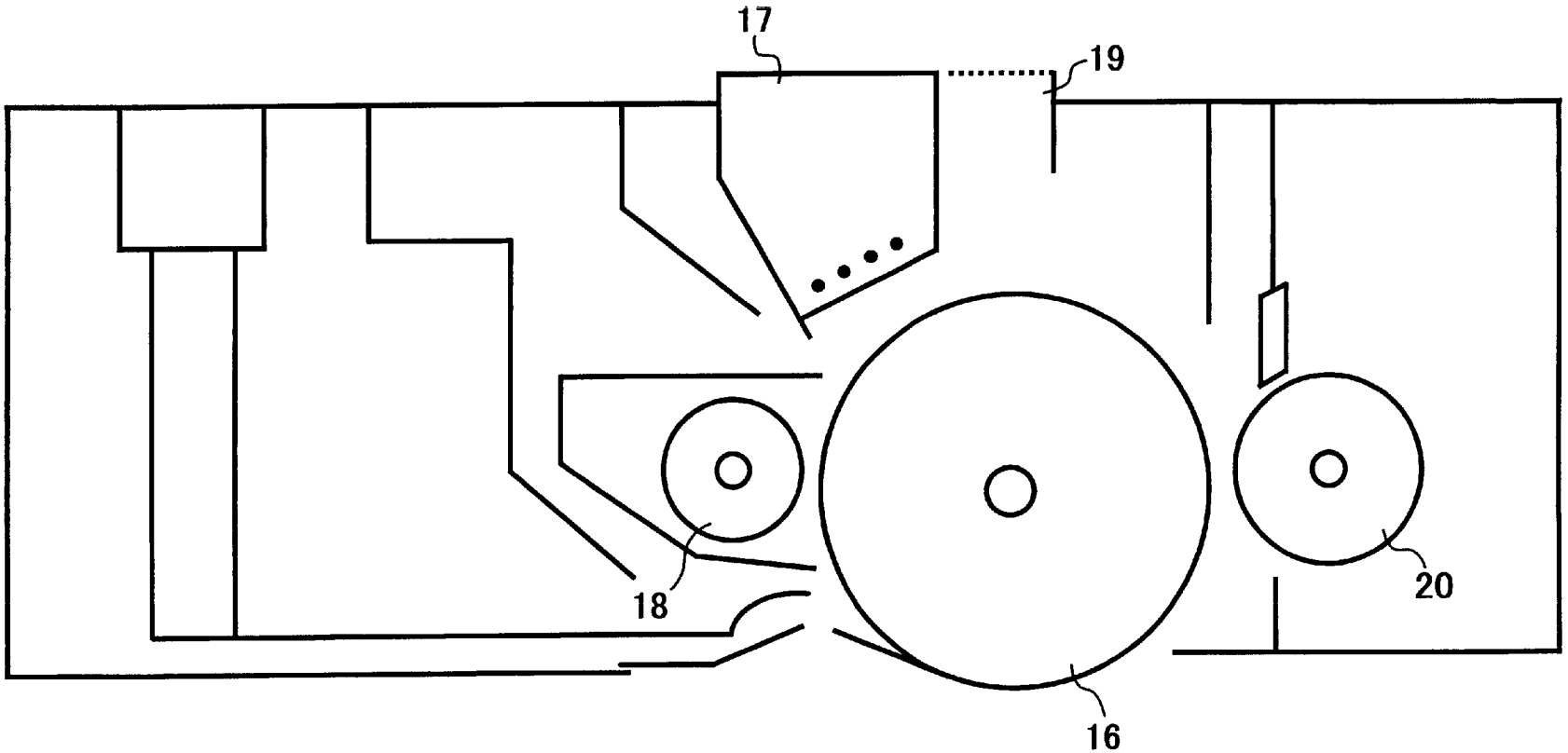
FIG. 5 is a schematic view of an embodiment of the process cartridge of the present invention.

There are many types of process cartridges, however, FIG. 5 is a schematic view illustrating an embodiment of the process cartridge of the present invention. The process cartridge includes a photoreceptor 16 which is the photoreceptor of the present invention, a charger 17, a cleaning brush 18, an imagewise light irradiation device 19 and a developing roller 20.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation)

Formation of Intermediate Layer

After containing a mixture of 1.5 parts of oil free alkyd resin (manufactured by Dainippon Ink & Chemicals, Inc. and tradenamed as Bekkolite M6401), 1 part of melamine resin(manufactured by Dainippon Ink & Chemicals, Inc. and tradenamed as Super Bekkamin G-821), 5 parts of titanium dioxide [manufactured by Ishihara Sangyo Kaisha Ltd. and tradenamed as Tipaque CR-EL], 22.5 parts of butanone into a ball mill pot, the mixture was ball-milled with ϕ10 mm alumina balls for 48 hours to prepare an intermediate layer coating liquid. This liquid was coated on an aluminum cylinder, and then dried for 20 minutes at 130° C. to form an intermediate layer of about 3.5 μm thick.

Formation of Charge Generation Layer

The following components were mixed and dispersed by a ball mill.

| | |
|---|---|
| Bisazo compound having the following formula (27) (Charge generation material) | 4.17 |
| Polyvinylbutyral resin [XYHL] | 0.83 |
| methylethylketone | 495 |

(27)

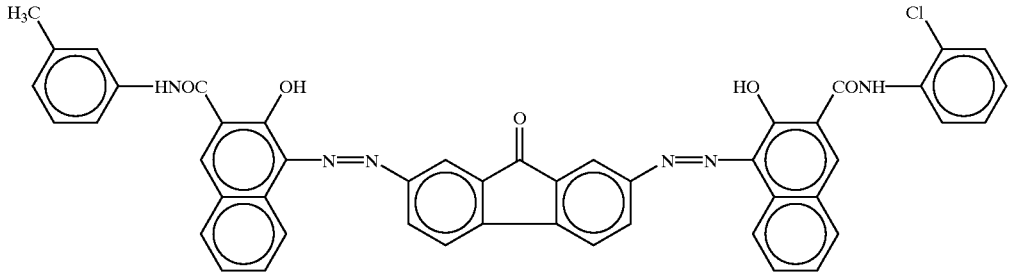

The dispersion liquid was coated onto the above prepared intermediate layer and then dried at room temperature to form a charge generation layer of about 0.5 μm thick.

Formation of Charge Transport Layer

The following components were dissolved into tetrahydrofuran to prepare a charge transport layer coating liquid.

| | |
|---|---|
| Aminobiphenyl compound having the following formula (28) (Charge transport material) | 7 |
| Deactivating agent having the following formula (29) | 0.07 |

(28)

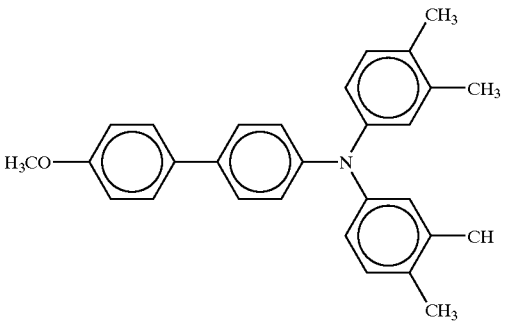

(29)

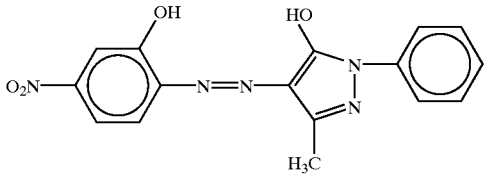

| | |
|---|---|
| Polycarbonate resin (manufactured by Teijin Ltd. and tradenamed as Panlite TS-2050) | 10 |

This liquid was coated onto the above prepared charge generation layer and then dried for 2 minutes at 80° C. and 20 minutes at 130° C. to form a charge transport layer of about 17 μm thick. Thus, a photoreceptor No. 1 was prepared.

Example 2

The procedure for preparation of the photoreceptor of Example 1 was repeated except that the aminobiphenyl compound having formula (28) was replaced with an α-phenylstilbene compound having the following formula (30), and the deactivating agent having formula (29) was replaced with a compound having the following formula (31).

(30)

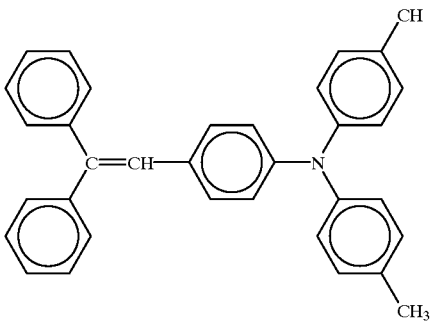

(31)

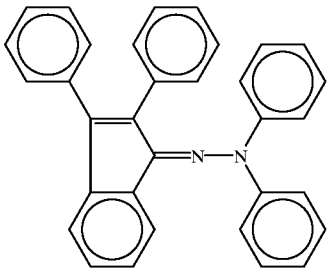

Thus a photoreceptor No. 2 was prepared.

Example 3

The procedure for preparation of the photoreceptor of Example 1 was repeated except that the bisazo compound having formula (27) was replaced with a hydrazone compound having the following formula (32), and the deactivating agent having formula (29) was replaced with 0.14 parts of a compound having the following formula (33).

Thus a photoreceptor No. 3 was prepared.

Comparative Examples 1, 2 and 3

The procedures for preparation of the photoreceptors of Examples 1, 2 or 3 were repeated except that the deactivating agent was not added to form comparative photoreceptors 1, 2 and 3.

Each of the thus prepared photoreceptors was loaded in a copier Ricoh Imagio MF2200 which has a recording density of 600 dpi and includes a process cartridge. The light source for writing images was changed to a LD emitting light having a wavelength of 405 nm. In addition, the copier was modified such that the light amount can be adjusted by an external LD driving unit. A running test in which 10,000 images were continuously produced was made while the initial dark electric potential and lighted electric potential of the photoreceptor were set at about −700(V) and about −100(V) respectively. The surface electric potential was measured during the running test. The images were carefully observed to determine whether dot images in which one dot image was arranged at one dot space interval were clearly reproduced. The image quality was classified into 3 grades.

Comparative Example 4, 5 and 6

In addition, for the purpose of clarifying problems of the photoreceptors (Comparative Examples 1, 2 and 3) when using a light source of a short wavelength (350 to 500 nm) corresponding to the light absorption range of the charge transport materials, the same evaluation was made on the photoreceptors of Comparative Examples 1, 2 and 3 (Comparative Examples 4, 5 and 6) while changing the light source to a LD of 655 nm in wavelength. The results are shown in Table 2.

Example 4

On an electroformed nickel belt, coating liquids for the following intermediate layer, charge generation layer and (32)

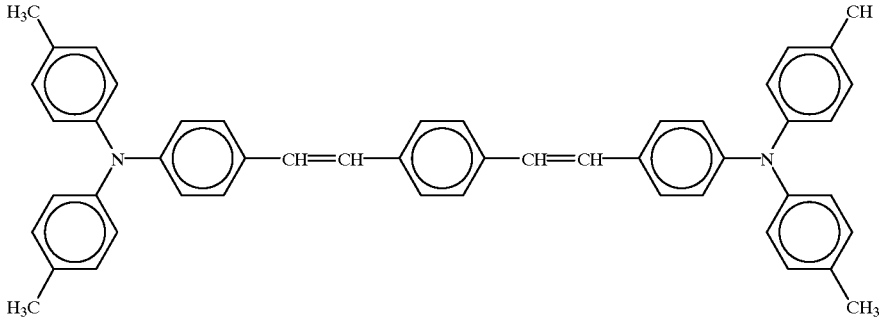

(33)

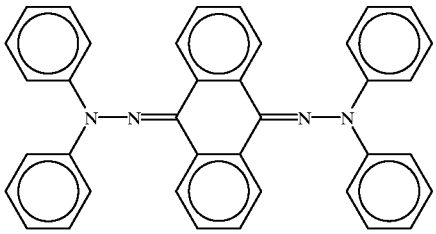

charge transport layer were sequentially coated and dried to form a layered photoreceptor No. 4 having an intermediate layer of about 6 m thick, an charge generation layer of about 0.3 μm thick and a charge transport layer of about 20 μm thick.

| Intermediate layer coating liquid | |
|---|---|
| Titanium dioxide (TA-300) | 5 |
| Copolymer polyamide resin (CM-8000 manufactured by Toray Industries, Inc.) | 4 |
| Methanol | 50 |
| Isopropanol | 20 |
| **Charge generation layer coating liquid** | |
| Y-form oxotitaniumphthalocyanine pigment powder | 4 |
| Polyvinylbutyral | 2 |
| Cyclohexanone | 50 |
| Tetrahydrofuran | 100 |
| **Charge transport layer coating liquid** | |
| Polycarbonate resin (Panlite TS-2050) | 10 |
| Charge transporting material having the following formula (34) | 9 |

(34)

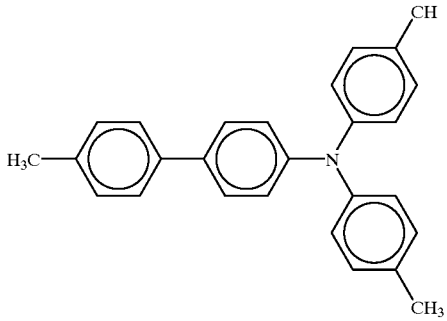

| | |
|---|---|
| Deactivating agent having the following formula (35) | 0.27 |

(35)

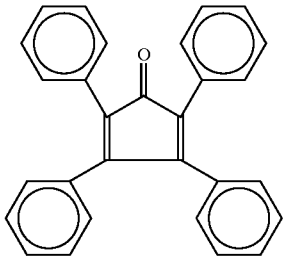

| | |
|---|---|
| Tetrahydrofuran | 80 |

The thus prepared photoreceptor belt was loaded in the image forming apparatus as shown in FIG. 4 (The pre-cleaning exposure was not performed). A light source of 488 nm Ar laser and a polygon mirror were used for writing images. An electrometer probe was set in the apparatus to measure the electric potential of the photoreceptor just before the development process.

Example 5

On an aluminium cylinder which had been anodized and sealed, the following charge generation layer and charge transport layer coating liquids were sequentially coated and dried to prepare the photoreceptor No. 5 of the present invention having a charge generation layer of 0.2 μm thick and a charge transport layer of 18 μm thick.

| Charge generation layer coating liquid | |
|---|---|
| τ-form metal-free phthalocyanine pigment powder | 3 |
| Charge generation material having formula (27) | 3 |
| Polyvinylbutyral resin (BM-S) | 1 |
| Cyclohexanone | 250 |
| Methylethylketone | 50 |

| Charge transport layer coating liquid | |
|---|---|
| Charge transport material having the following formula (36) | 7 |

(36)

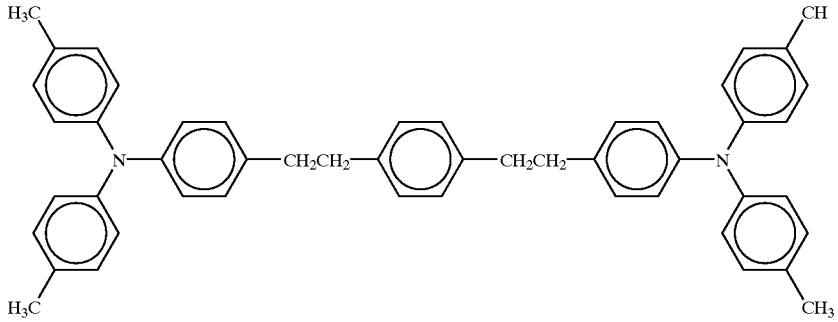

| | |
|---|---|
| Polycarbonate resin (Panlite TS-2050) | 10 |

| | |
|---|---|
| Deactivating agent having the following formula (37) | 0.01 |
| 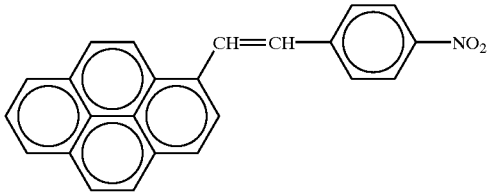 (37) | |
| Methylenechloride | 80 |

The measurement was made changing a light source for image exposure to a laser diode of 450 nm in wavelength. The results are shown in Table 1 and 2.

TABLE 1

| | Photo-receptor No. | Wave-Length of Writing Light (nm) | Surface Electric Potential (after running test) Dark Area (V) | Lighted Area (V) | Dot Reproducibility Initial Stage | After Running Test |
|---|---|---|---|---|---|---|
| Example 1 | 1 | 405 | −720 | −105 | ○ | ○ |
| Example 2 | 2 | 405 | −680 | −125 | ○ | ○ |
| Example 3 | 3 | 405 | −575 | −115 | ○ | ○ |
| Example 4 | 4 | 488 | −710 | −100 | ○ | ○ |
| Example 5 | 5 | 450 | −680 | −120 | ○ | ○ |
| Comparative Example 1 | Comparative photo-receptor 1 | 405 | −555 | −300 | Δ | x |
| Comparative Example 2 | Comparative Photo-receptor 2 | 405 | −510 | −260 | Δ | x |
| Comparative Example 3 | Comparative Photo-receptor 3 | 405 | −320 | −60 | x | x |

TABLE 2

| | Photo-receptor No. | Wave-Length of Writing Light (nm) | Surface Electric Potential (after running test) Dark Area (V) | Lighted Area (V) | Dot Reproducibility Initial Stage | After Running Test |
|---|---|---|---|---|---|---|
| Comparative Example 4 | Comparative photo-receptor 1 | 655 | −705 | −100 | ○ | ○ |
| Comparative Example 5 | Comparative photo-receptor 2 | 655 | −710 | −120 | ○ | ○ |

TABLE 2-continued

| | Photo-receptor No. | Wave-Length of Writing Light (nm) | Surface Electric Potential (after running test) Dark Area (V) | Lighted Area (V) | Dot Reproducibility Initial Stage | After Running Test |
|---|---|---|---|---|---|---|
| Comparative Example 6 | Comparative photo-receptor 3 | 655 | −685 | −95 | ○ | Δ |

○ Clear
Δ Rather blurred
x Not reproduced

The above result of Table 1 proves that the photoreceptors of Examples 1 to 5 and an electrophotographic image forming apparatus using the photoreceptor, which has a writing light source emitting a light having a wavelength of 350 to 500 nm are good at electric potential stability in repeated usage and in dot reproducibility and its stability. On the other hand, the result of Comparative Example 1 to 3, in which photoreceptors without the deactivating agents proves that deterioration of electric potential of a dark area, an increase of electric potential of a lighted area and a poor dot image resolution from the beginning. In addition, from a comparison between the result of Table 2 (Comparative Example 4 to 6) and Comparative Example 1 to 3, it is evident that a shorter wavelength of a writing light adversely affects the electric potential stability and the image resolution. Therefore, the present invention provides an image forming apparatus using the photoreceptor, which is good at electric potential and produces a high resolution image in repeated usage with a writing light having a wavelength of 350 to 500 nm as well as the result from Table 2, in which a writing light having the current long wavelength is used.

According to the present invention, with the methods for forming a photoreceptor as above-mentioned Examples 1 to 5, even when a LD or a LED emitting a light having a wavelength of 350 to 500 nm is used as a writing light source in a digital recording method, an electrophotographic photoreceptor having a stable property for practical use and producing a high resolution output image is provided. Also a process cartridge and an electrophotographic image forming apparatus having the photoreceptor are provided with the methods as above-mentioned Examples 1 to 5.

This document claims priority and contains subject matter related to Japanese Patent Application No.2000-202091 filed on Jul. 4, 2000 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

a conductive support; and a photosensitive layer;

wherein said photosensitive layer comprises a charge transport material and a non-fluorescent deactivating agent;

wherein said deactivating agent allows said charge transport material to transfer from an excited state to a normal state while deactivating without radiation.

2. The electrophotographic photoreceptor of claim 1, wherein said charge transport material has an excitation wavelength of from 350 to 500 nm.

3. The electrophotographic photoreceptor of claim 1, wherein said charge transport material has an excitation wavelength of from 400 to 450 nm.

4. The electrophotographic photoreceptor of claim 1, wherein the deactivating agent comprises an aromatic hydrocarbon compound having at least one member selected from the group consisting of a nitro group, a carbonyl group, an azo group and a hydrazone group.

5. The electrophotographic photoreceptor of claim 4, wherein the aromatic hydrocarbon compound is a high molecular weight aromatic hydrocarbon compound in which one or more aromatic hydrocarbon groups are combined through at least one group selected from the group consisting of an ethylene group, a vinylene group, an ester group, a carbonyloxy group and a phenylene group.

6. The electrophotographic photoreceptor of claim 5, wherein the high molecular weight aromatic compound has a polystyrene-conversion number average molecular weight of from 1,000 to 1,000,000.

7. The electrophotographic photoreceptor of claim 1, wherein the deactivating agent has a charge transportability.

8. The electrophotographic photoreceptor of claim 1, wherein the charge transport material and the deactivating agent have a difference in ionization potential of not greater than 0.4 eV.

9. The electrophotographic photoreceptor of claim 1, wherein the deactivating agent is present in the photosensitive layer in an amount of from 1 to 50% by weight.

10. The electrophotographic photoreceptor of claim 1, wherein the photosensitive layer comprises a charge transport layer comprising said charge transport material and said deactivating agent, and a charge generation layer comprising a charge generation material.

11. The electrophotographic photoreceptor of claim 10, wherein the charge transport layer is between said conductive support and said charge generation layer.

12. The electrophotographic photoreceptor of claim 10, wherein the charge generation layer is between said conductive support and said charge transport layer.

13. The electrophotographic photoreceptor of claim 10, wherein the deactivating agent is present in the charge transport layer in an amount of from 0.005 to 5% by weight.

14. The electrophotographic photoreceptor of claim 10, wherein the charge transport layer absorbs light at a wavelength of from 350 to 500 nm.

15. The electrophotographic photoreceptor of claim 10, wherein the charge transport material and the deactivating agent have a difference in ionization potential of not greater than 0.4 eV.

16. The electrophotographic photoreceptor of claim 1, wherein the charge transport material is a hole transport material.

17. The electrophotographic photoreceptor of claim 1, wherein the charge transport material is an electron transport material.

18. The electrophotographic photoreceptor of claim 1, wherein the photosensitive layer further comprises a binder resin, and the charge transport material is present in an amount of from 20 to 300 parts by weight per 100 parts by weight of binder resin.

19. The electrophotographic photoreceptor of claim 1, further comprising a protective layer on said photosensitive layer.

20. An electrophotographic photoreceptor, comprising:

a conductive substrate means; and a photosensitive layer;

wherein said photosensitive layer comprises a means of charge transport and a non-fluorescent means for allowing the charge transport means to transfer from an excited state to a normal state while deactivating without radiation.

21. The electrophotographic photoreceptor of claim 20, wherein the photosensitive layer comprises a charge transport layer comprising said means of charge transport and said means for allowing the charge transport means to transfer from an excited state to a normal state while deactivating without radiation, and a charge generation layer comprising a charge generation means.

22. The electrophotographic photoreceptor of claim 20, further comprising a protective layer on said photosensitive layer.

23. An electrophotographic image forming apparatus, comprising:

a photoreceptor;

a charger configured to charge the photoreceptor;

an image irradiator configured to irradiate the photoreceptor with light to form an electrostatic latent image on the photoreceptor;

an image developer configured to develop the electrostatic latent image with a toner to form a toner image on the photoreceptor; and an image transfer configured to transfer the toner image to a receiving material;

wherein the photoreceptor comprises a conductive substrate and a photosensitive layer and said photosensitive layer comprises a charge transport material and a non-fluorescent deactivating agent;

wherein said deactivating agent allows said charge transport material to transfer from an excited state to a normal state while deactivating without radiation.

24. The electrophotographic image forming apparatus of claim 23, wherein said image irradiator irradiates the photoreceptor with light of a wavelength of from 350 to 500 nm and wherein said charge transport material has an excitation wavelength of from 350 to 500 nm.

25. The electrophotographic image forming apparatus of claim 24, wherein said charge transport material has an excitation wavelength of from 400 to 450 nm.

26. The electrophotographic image forming apparatus of claim 23, wherein the deactivating agent comprises an aromatic hydrocarbon compound having at least one member selected from the group consisting of a nitro group, a carbonyl group, an azo group and a hydrazone group.

27. The electrophotographic image forming apparatus of claim 23, wherein the aromatic hydrocarbon compound is a high molecular weight aromatic hydrocarbon compound in which one or more aromatic hydrocarbon groups are combined through at least one group selected from the group consisting of an ethylene group, a vinylene group, an ester group, a carbonyloxy group and a phenylene group.

28. The electrophotographic image forming apparatus of claim 27, wherein the high molecular weight aromatic compound has a polystyrene-conversion number average molecular weight of from 1,000 to 1,000,000.

29. The electrophotographic image forming apparatus of claim 23, wherein the deactivating agent has a charge transportability.

30. The electrophotographic image forming apparatus of claim 23, wherein the charge transport material and the deactivating agent have a difference in ionization potential of not greater than 0.4 eV.

31. The electrophotographic image forming apparatus of claim 23, wherein the deactivating agent is present in the photosensitive layer in an amount of from 1 to 50% by weight.

32. The electrophotographic image forming apparatus of claim 23, wherein the photosensitive layer comprises a charge transport layer comprising said charge transport material and said deactivating agent, and a charge generation layer comprising a charge generation material.

33. The electrophotographic image forming apparatus of claim 32, wherein the charge transport layer is between said conductive support and said charge generation layer.

34. The electrophotographic image forming apparatus of claim 32, wherein the charge generation layer is between said conductive support and said charge transport layer.

35. The electrophotographic image forming apparatus of claim 32, wherein the deactivating agent is present in the charge transport layer in an amount of from 0.005 to 5% by weight.

36. The electrophotographic image forming apparatus of claim 32, wherein the charge transport layer absorbs light at a wavelength of from 350 to 500 nm.

37. The electrophotographic image forming apparatus of claim 31, wherein the charge transport material and the deactivating agent have a difference in ionization potential of not greater than 0.4 eV.

38. The electrophotographic image forming apparatus of claim 23, wherein the charge transport material is a hole transport material.

39. The electrophotographic image forming apparatus of claim 23, wherein the charge transport material is an electron transport material.

40. The electrophotographic image forming apparatus of claim 23, wherein the photosensitive layer further comprises a binder resin, and the charge transport material is present in an amount of from 20 to 300 parts by weight per 100 parts by weight of binder resin.

41. The electrophotographic image forming apparatus of claim 23, further comprising a protective layer on said photosensitive layer.

42. An electrophotographic image forming apparatus, comprising:

a photoreceptor means;

a charger means;

an image irradiator means;

an image developer means; and an image transfer means;

wherein the photoreceptor means comprises a conductive substrate and a photosensitive layer and said photosensitive layer comprises a means of charge transport and a non-fluorescent means for allowing the charge transport means to transfer from an excited state to a normal state while deactivating without radiation.

43. A process cartridge, comprising:

a photoreceptor; and at least one device selected from the group consisting of a charger, an image developer and a cleaner;

wherein the photoreceptor comprises a conductive substrate and a photosensitive layer; and wherein said photosensitive layer comprises a charge transport material and a non-fluorescent deactivating agent;

wherein said deactivating agent allows said charge transport material to transfer from an excited state to a normal state while deactivating without radiation.

44. The process cartridge of claim 43, wherein said charge transport material has an excitation wavelength of from 350 to 500 nm.

45. The process cartridge of claim 43, wherein said charge transport material has an excitation wavelength of from 400 to 450 nm.

46. The process cartridge of claim 43, wherein the deactivating agent comprises an aromatic hydrocarbon compound having at least one member selected from the group consisting of a nitro group, a carbonyl group, an azo group and a hydrazone group.

47. The process cartridge of claim 43, wherein the aromatic hydrocarbon compound is a high molecular weight aromatic hydrocarbon compound in which one or more aromatic hydrocarbon groups are combined through at least one group selected from the group consisting of an ethylene group, a vinylene group, an ester group, a carbonyloxy group and a phenylene group.

48. The process cartridge of claim 47, wherein the high molecular weight aromatic compound has a polystyrene-conversion number average molecular weight of from 1,000 to 1,000,000.

49. The process cartridge of claim 43, wherein the deactivating agent has a charge transportability.

50. The process cartridge of claim 43, wherein the charge transport material and the deactivating agent have a difference in ionization potential of not greater than 0.4 eV.

51. The process cartridge of claim 43, wherein the deactivating agent is present in the photosensitive layer in an amount of from 1 to 50% by weight.

52. The process cartridge of claim 43, wherein the photosensitive layer comprises a charge transport layer comprising said charge transport material and said deactivating agent, and a charge generation layer comprising a charge generation material.

53. The process cartridge of claim 52, wherein the charge transport layer is between said conductive support and said charge generation layer.

54. The process cartridge of claim 52, wherein the charge generation layer is between said conductive support and said charge transport layer.

55. The process cartridge of claim 52, wherein the deactivating agent is present in the charge transport layer in an amount of from 0.005 to 5% by weight.

56. The process cartridge of claim 52, wherein the charge transport layer absorbs light at a wavelength of from 350 to 500 nm.

57. The process cartridge of claim 52, wherein the charge transport material and the deactivating agent have a difference in ionization potential of not greater than 0.4 eV.

58. The process cartridge of claim 43, wherein the deactivating agent is non-fluorescent.

59. The process cartridge of claim 43, wherein the charge transport material is a hole transport material.

60. The process cartridge of claim 43, wherein the charge transport material is an electron transport material.

61. The process cartridge of claim 43, wherein the photosensitive layer further comprises a binder resin, and the charge transport material is present in an amount of from 20 to 300 parts by weight per 100 parts by weight of binder resin.

62. The process cartridge of claim 43, further comprising a protective layer on said photosensitive layer.

63. A process cartridge, comprising:

a photoreceptor means; and at least one device selected from the group consisting of a charger means, an image developer means and a cleaner means;

wherein the photoreceptor means comprises a conductive substrate and a photosensitive layer and said photosensitive layer comprises a means of charge transport and a non-fluorescent means for allowing the charge transport means to transfer from an excited state to a normal state while deactivating without radiation.

* * * * *